US009035858B2

(12) United States Patent
Kim et al.

(10) Patent No.: US 9,035,858 B2
(45) Date of Patent: May 19, 2015

(54) PIXEL WITH REVERSE BIAS POWER SOURCE AND ORGANIC LIGHT EMITTING DEVICE USING THE SAME

(75) Inventors: Do-Ik Kim, Yongin (KR); Joo-Hyeon Jeong, Yongin (KR)

(73) Assignee: Samsung Display Co., Ltd., Gyeonggi-Do (KR)

( * ) Notice: Subject to any disclaimer, the term of this patent is extended or adjusted under 35 U.S.C. 154(b) by 396 days.

(21) Appl. No.: 13/207,369

(22) Filed: Aug. 10, 2011

(65) Prior Publication Data

US 2012/0162176 A1 Jun. 28, 2012

(30) Foreign Application Priority Data

Dec. 28, 2010 (KR) ..... 10-2010-0136809

(51) Int. Cl.
*G09G 3/32* (2006.01)

(52) U.S. Cl.
CPC ..... *G09G 3/3258* (2013.01); *G09G 2300/0819* (2013.01); *G09G 2320/0214* (2013.01); *G09G 2320/0238* (2013.01); *G09G 2320/045* (2013.01)

(58) Field of Classification Search
CPC ..... G09G 3/3233
USPC ..... 345/82
See application file for complete search history.

(56) References Cited

U.S. PATENT DOCUMENTS

| | | | | |
|---|---|---|---|---|
| 6,909,240 | B2 * | 6/2005 | Osame et al. | 315/169.1 |
| 2003/0107565 | A1 * | 6/2003 | Libsch et al. | 345/211 |
| 2003/0179166 | A1 * | 9/2003 | Li | 345/84 |
| 2004/0004589 | A1 * | 1/2004 | Shih | 345/82 |
| 2004/0130513 | A1 * | 7/2004 | Miyazawa | 345/76 |
| 2005/0099372 | A1 * | 5/2005 | Nakamura et al. | 345/79 |
| 2005/0134189 | A1 * | 6/2005 | Osame et al. | 315/169.1 |
| 2006/0238475 | A1 * | 10/2006 | Oh | 345/92 |
| 2007/0018078 | A1 * | 1/2007 | Miyazawa | 250/214.1 |
| 2007/0109232 | A1 * | 5/2007 | Yamamoto et al. | 345/77 |
| 2008/0094320 | A1 * | 4/2008 | Parikh et al. | 345/76 |
| 2008/0186301 | A1 * | 8/2008 | Park et al. | 345/211 |
| 2009/0219231 | A1 * | 9/2009 | Yamamoto et al. | 345/76 |
| 2010/0164847 | A1 * | 7/2010 | Lee et al. | 345/77 |

FOREIGN PATENT DOCUMENTS

| | | | |
|---|---|---|---|
| KR | 10-0741973 | B1 | 7/2007 |
| KR | 10-2007-0103897 | A | 10/2007 |
| KR | 10-2009-0123562 | A | 12/2009 |

* cited by examiner

*Primary Examiner* — Claire X Pappas
*Assistant Examiner* — Robert Stone
(74) *Attorney, Agent, or Firm* — Knobbe Martens Olson & Bear LLP

(57) ABSTRACT

A pixel and an organic light emitting diode (OLED) display device including the same are disclosed. The pixel includes an organic light emitting diode and an inverse voltage transistor positioned between an anode of the organic light emitting diode and a reverse bias power source, and configured to transmit the inverse voltage to the organic light emitting diode (OLED).

19 Claims, 8 Drawing Sheets

PIXEL WITH REVERSE BIAS POWER SOURCE AND ORGANIC LIGHT EMITTING DEVICE USING THE SAME

CROSS-REFERENCE TO RELATED APPLICATIONS

This application claims priority to and the benefit of Korean Patent Application No. 10-2010-0136809 filed in the Korean Intellectual Property Office on Dec. 28, 2010, the entire contents of which are incorporated herein by reference.

BACKGROUND

1. Field

The disclosed technology relates to a pixel and an organic light emitting diode (OLED) display device including the same, and in detail, relates to a pixel and an organic light emitting diode (OLED) display device including the same applying an inverse voltage if the organic light emitting diode (OLED) is not emitting light.

2. Description of the Related Technology

Various flat panel displays having reduced weight and volume when compared with a cathode ray tube have been developed. Flat panel displays include liquid crystal displays (LCD), field emission displays (FED), plasma display panels (PDP), organic light emitting diode (OLED) displays, and the like.

Among the flat panel displays, the organic light emitting diode display, which displays images by using an organic light emitting diode (OLED) that generates light by recombining electrons and holes, has a fast response speed, is driven with low power consumption, and has excellent emission efficiency, luminance, and viewing angle, such that it has recently been preferred.

Methods of driving an organic light emitting diode (OLED) display device generally include a passive matrix method and an active matrix method.

A passive matrix light emitting display device alternately has anodes and cathodes in the display area in a matrix, and pixels are formed at intersections of anode and cathode lines. In contrast, the active matrix light emitting display device has a thin film transistor for each pixel and each pixel is controlled by using the thin film transistor. A significant difference between the active matrix light emitting display device and the passive matrix light emitting display device is the difference of light emitting times of the organic light emitting device. The passive matrix light emitting display device substantially instantaneously emits light from the organic emission layer with high luminance, and the active matrix light emitting display device continuously emits light from the organic emission layer with low luminance.

In the active matrix light emitting display device, parasitic capacitance is low and power consumption is low compared with the passive matrix light emitting display device, however luminance is non-uniform. For this, a voltage programming method or a current programming method is used to compensate the characteristic of the driving transistor.

That is, each pixel of the organic light emitting diode (OLED) display device includes an organic light emitting diode (OLED), a driving transistor controlling a current to drive the organic light emitting diode (OLED), a switching transistor applying a data signal for expression of grayscales to the driving transistor, and a capacitor to store data voltages for the organic light emitting diode (OLED) according to desired timing by controlling the driving transistor. A voltage difference between the source and the gate of the driving transistor is stored in the capacitor, and then the driving transistor is connected to a voltage source to flow current as a video signal current in the driving transistor. Thus, the value of the current applied to the organic light emitting diode (OLED) is based on the video signal, and may be unrelated to the difference characteristic of the driving transistor such that the non-uniform luminance is improved.

However, in this method, the organic light emitting diode (OLED) is turned on/off by the switching of the driving transistor, and when the driving transistor is turned off, the anode of the organic light emitting diode (OLED) floats, and the life-span of the organic light emitting diode (OLED) is decreased. Also, undesired light emission of the organic light emitting diode (OLED) may be generated by a leakage current when the driving transistor is off such that the contrast ratio may be deteriorated. Accordingly, it is desired to develop a pixel in which the leakage current does not flow in the organic light emitting element when the driving transistor is off.

The above information disclosed in this Background section is only for enhancement of understanding of the background of the invention and therefore it may contain information that does not form the prior art that is already known in this country to a person of ordinary skill in the art.

SUMMARY OF CERTAIN INVENTIVE ASPECTS

One inventive aspect is a pixel. The pixel includes a pixel driver formed near an intersection of a scan line and a data line, and the pixel driver is connected to a first power source voltage supply line, and includes a driving transistor configured to transmit a driving current according to a data voltage corresponding to a data signal from the data line, where the data voltage is applied to the driving transistor according to a scan signal transmitted from the scan line. The pixel also includes an organic light emitting diode (OLED) configured to emit light according to the driving current, and an inverse voltage transistor positioned between an anode of the organic light emitting diode (OLED) and a reverse bias power source. The inverse voltage transistor includes a gate electrode connected to one of a first electrode and a second electrode, and is configured to transmit an inverse voltage to the organic light emitting diode (OLED) during a turn-off period of the driving transistor.

Another inventive aspect is an organic light emitting diode (OLED) display device. The display device includes a scan driver transmitting a plurality of scan signals to a plurality of scan lines, a data driver transmitting a plurality of data signals to a plurality of data lines, and a controller controlling the scan driver and the data driver, and generating and supplying an image data signal corresponding to a video signal to the data driver. The display device also includes a display unit with a plurality of pixels respectively connected to a corresponding scan line of a plurality of scan lines and a corresponding data line of a plurality of data lines, where the plurality of pixels emit light according to the image data signal, and a power source supply supplying a first power source voltage, a second power source voltage, and an inverse voltage to the plurality of pixels. The plurality of pixels respectively include a driving transistor configured to transmit a driving current according to a data voltage corresponding to the data signal transmitted from the data line, an organic light emitting diode (OLED) configured to emit light according to the driving current, and an inverse voltage transistor positioned between an anode of the organic light emitting diode (OLED) and a reverse bias power source. The inverse voltage transistor includes a gate electrode connected to one of a first electrode and a second electrode, and is configured to transmit the inverse voltage to the organic light emitting diode (OLED).

DETAILED DESCRIPTION OF CERTAIN INVENTIVE EMBODIMENTS

Figure 1:
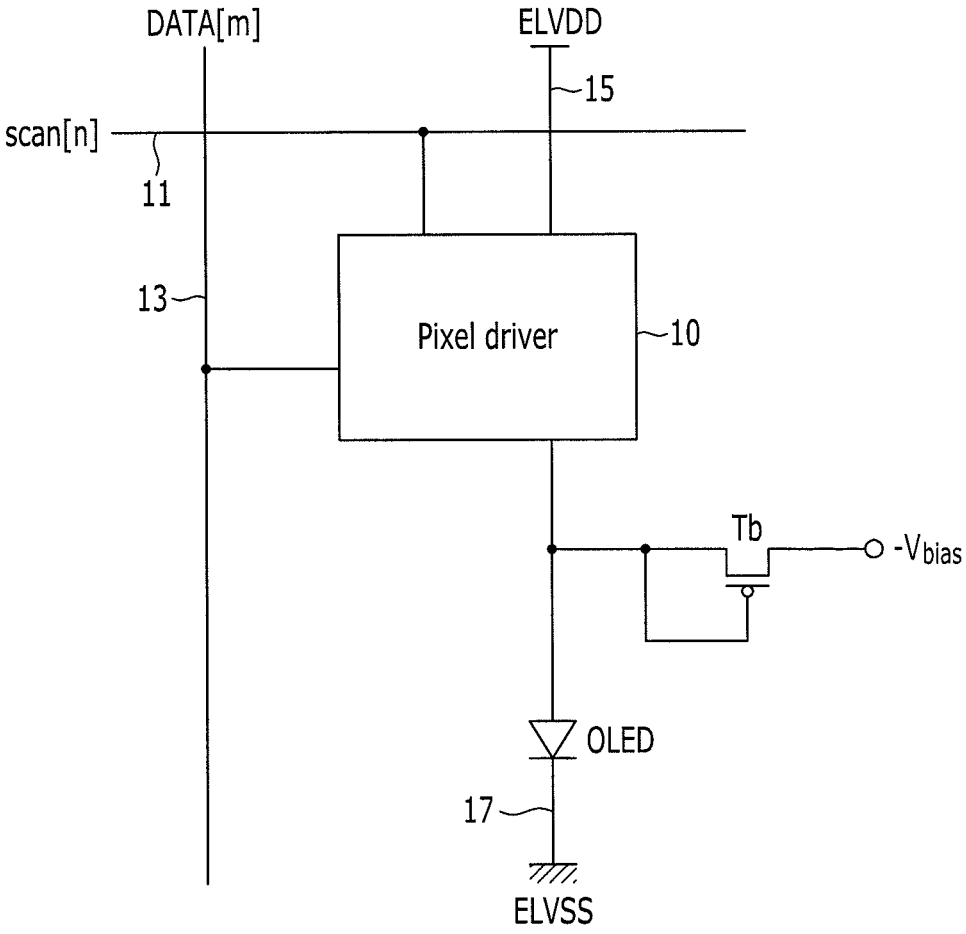
FIG. 1 is a block diagram of a pixel of an organic light emitting diode (OLED) display device according to an exemplary embodiment.

Various aspects and features are described more fully hereinafter with reference to the accompanying drawings, in which exemplary embodiments are shown. As those skilled in the art would realize, the described embodiments may be modified in various ways, without departing from the spirit or scope of the present invention.

In the exemplary embodiments, like reference numerals generally designate like elements throughout the specification. Some features are discussed representatively in a first exemplary embodiment, and elements other than those features of the first exemplary embodiment are described for subsequent embodiments.

The drawings and description are to be regarded as illustrative in nature and not restrictive. Throughout this specification and the claims that follow, when it is described that an element is "coupled" to another element, the element may be "directly coupled" to the other element or "electrically coupled" to the other element through a third element. In addition, unless explicitly described to the contrary, the word "comprise" and variations such as "comprises" or "comprising" will be understood to imply the inclusion of stated elements but not the exclusion of any other elements.

FIG. 1 is a block diagram of a pixel of an organic light emitting diode (OLED) display device according to an exemplary embodiment. Referring to FIG. 1, a pixel according to an exemplary embodiment of the present invention includes a pixel driver 10 positioned near an intersection region of a corresponding scan line 11 and a corresponding data line 13 and connected to a supply line 15 of a first power source voltage ELVDD, an organic light emitting diode (OLED) connected to a supply line 17 of a second power source voltage ELVSS of a lower voltage than the first power source voltage ELVDD, and an inverse voltage transistor Tb connected to the organic light emitting diode OLED and a supply line of an inverse voltage−Vbias.

The inverse voltage transistor Tb includes a gate electrode and two electrodes, that is, a first electrode and a second electrode, between which a channel is formed according to a voltage applied to the gate electrode. The inverse voltage transistor Tb of FIG. 1 is only an exemplary embodiment and may be variously constituted, and additional description is given with regard to the drawings.

The pixel driver 10 includes a plurality of transistors and a capacitor. If the pixel driver 10 is activated in response to the scan signal scan[n] supplied from the corresponding scan line 11, the data signal DATA[m] is supplied from the corresponding data line 13. The data voltage according to the data signal DATA[m] applied to the pixel driver 10 is stored to the capacitor of the pixel driver 10. The data voltage of the stored data signal DATA[m] is generated to induce a desired driving current which is transmitted to the organic light emitting diode (OLED).

The pixel driver 10 is connected to the supply line 15 supplying the first power source voltage ELVDD of a positive value for generation of the driving current.

A basic structure of the pixel driver 10 includes two transistors and one capacitor (a 2TR1CAP structure). The detailed circuit constitution of the pixel driver 10 will be described with regard to the drawings, however the pixel made of only the 2TR1CAP structure is a structure in which the anode of the organic light emitting diode (OLED) floats when the driving transistor is turned off such that the charges trapped in the organic light emitting diode (OLED) can be discharged. In this conventional pixel structure, the life-span characteristic of the organic light emitting diode (OLED) is low.

Accordingly, the pixel according to an exemplary embodiment of the present invention of FIG. 1 connects the inverse voltage transistor Tb to the anode of the organic light emitting diode (OLED), and thereby the inverse voltage−Vbias is applied to the anode.

The organic light emitting diode (OLED) is connected between the pixel driver 10 and the supply line 17 of the second power source voltage ELVSS that is the negative power source voltage or the ground voltage. The organic light emitting diode (OLED) receives the driving current corresponding to the data voltage according to the data signal DATA[m] supplied to the pixel driver 10, and in response emits light having a certain luminance. In this way, to emit the light for the organic light emitting diode (OLED), the pixel driver 10 is activated such that the driving current is supplied. In addition, in an exemplary embodiment, when light is not emitted, the inverse voltage−Vbias is applied through the inverse voltage transistor Tb as in FIG. 1 such that the organic light emitting diode (OLED) is insulated and the leakage current does not flow.

Figure 2A:
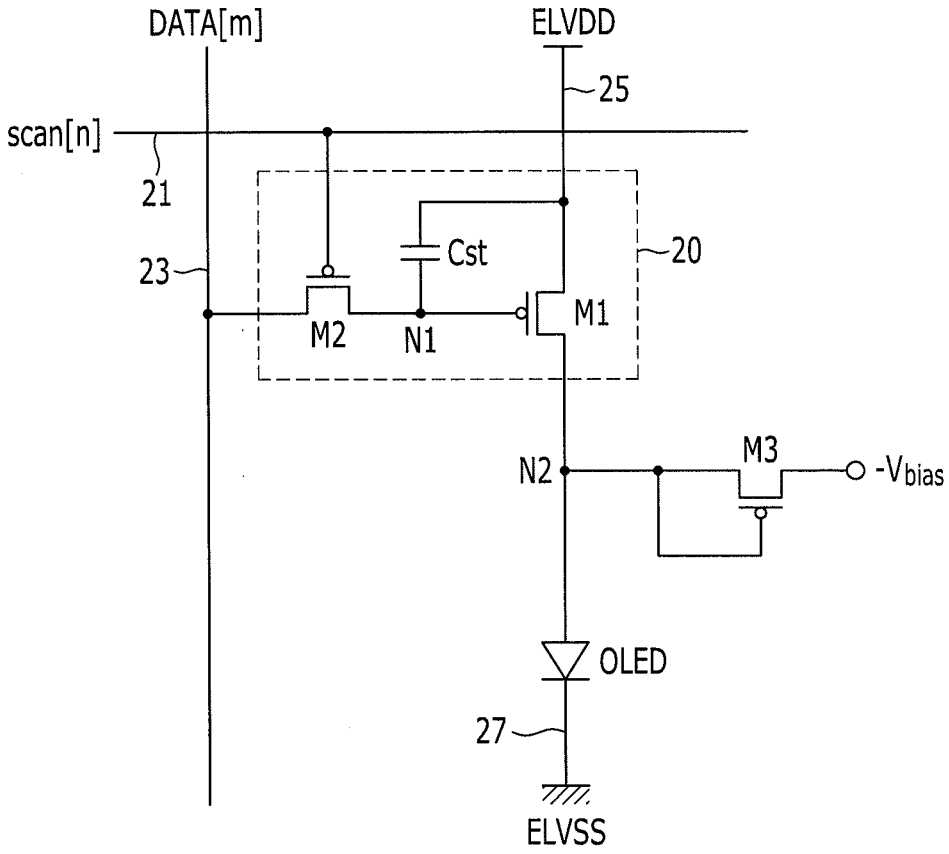
FIG. 2A is a circuit diagram of a first exemplary embodiment of the pixel shown in FIG. 1.
Figure 3:
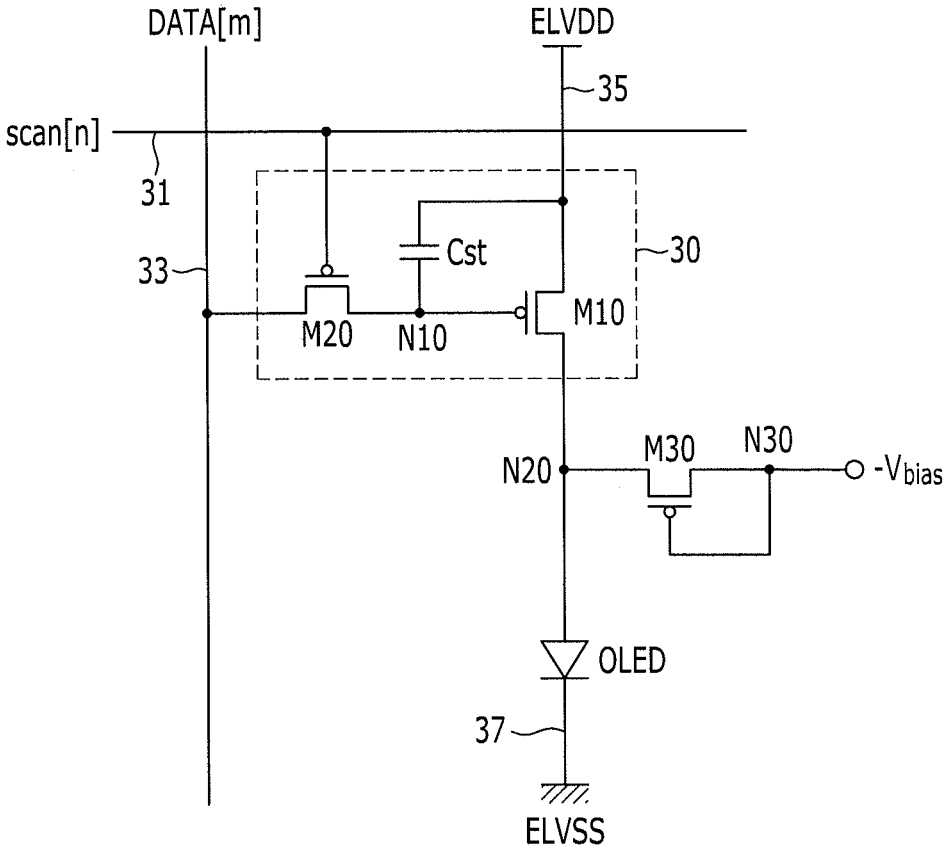
FIG. 3 is a circuit diagram of a second exemplary embodiment of the pixel shown in FIG. 1.

Hereafter, a circuit constitution of the pixel driver 10 and the inverse voltage transistor Tb according to various exemplary embodiments of the pixel are described. FIG. 2A and FIG. 3 are circuit diagrams according to an exemplary embodiment of a pixel in which all the transistors are PMOS transistors.

Referring to the pixel circuit diagram of FIG. 2A according to a first exemplary embodiment, the pixel includes a pixel driver 20, an organic light emitting diode (OLED), and an inverse voltage transistor M3.

The pixel driver 20 as the basic 2TR1CAP structure includes two transistors, that is, a driving transistor M1 and a switching transistor M2, and one storage) capacitor Cst. The gate electrode of the switching transistor M2 is connected to a corresponding scan line 21, the source electrode is connected to a corresponding data line 23, and the drain electrode is connected to a first node N1. Accordingly, the switching transistor M2 executes the on/off operation in response to the scan signal scan[n] transmitted through the scan line 21. If the scan signal scan[n] is transmitted as a gate-on voltage level, the switching transistor M2 is turned on and receives the data signal DATA[m] from the data line 23 to transmit the data voltage to the first node N1.

The storage capacitor Cst includes one electrode connected to the first node N1 and the other electrode connected to a supply line 25 of the first power source voltage ELVDD. The storage capacitor Cst stores the voltage according to a voltage difference of both electrodes, that is, a voltage corresponding to a voltage difference between the data voltage transmitted to the first node N1 and the first power source voltage ELVDD after the switching transistor M2 is turned on. The driving current is generated according to a voltage corresponding to the data voltage stored to the storage capacitor Cst.

The driving transistor M1 includes a gate electrode connected to the first node N1, a source electrode connected to the supply line 25 of the first power source voltage ELVDD, and a drain electrode connected to the second node N2. The anode of the organic light emitting diode (OLED) is connected to the second node N2, and the driving transistor M1 is connected between the supply line 25 of the first power source voltage ELVDD and the organic light emitting diode (OLED).

The gate electrode and the source electrode of the driving transistor M1 are respectively connected to two electrodes of the storage capacitor Cst, and a voltage corresponding to the voltage difference across the electrodes of the storage capacitor Cst corresponds to the voltage Vgs between the gate and the source of the driving transistor M1, and the voltage Vgs between the gate and the source is stored to the storage capacitor Cst.

During a period in which the driving transistor M1 of the pixel driver 20 is turned on, the driving current generated in the driving transistor M1 flows such that the organic light emitting diode (OLED) emits light.

However, during a period in which the driving transistor M1 of the pixel driver 20 is turned off, the path of the driving current is not formed from the driving transistor M1 to the organic light emitting diode (OLED) such that the anode of the organic light emitting diode (OLED) floats. As a result, over time, the current for a given Vgs decreases according to the resistance increase of the organic light emitting diode (OLED). Furthermore, leakage current may undesirably flow from the driving transistor M1 such that light emission may occur.

At least to address these concerns, in the exemplary embodiment of FIG. 2A, the inverse voltage transistor M3 is connected to the driving transistor M1 and the anode of the organic light emitting diode (OLED), and inverse voltage−Vbias is applied during the period in which the driving transistor M1 is turned off. In detail, the gate electrode and the source electrode of the inverse voltage transistor M3 according to the exemplary embodiment of FIG. 2A are connected together to the second node N2. Also, the drain electrode is connected to the supply line of the inverse voltage−Vbias.

The gate electrode and the source electrode of the inverse voltage transistor M3 are connected together such that the voltage Vgs between the gate and source electrodes is 0V, however the transistor characteristic is controlled for a current of a small amount to flow when the threshold voltage is shifted and the voltage Vgs between the gate and source electrodes is 0V.

Figure 2B:
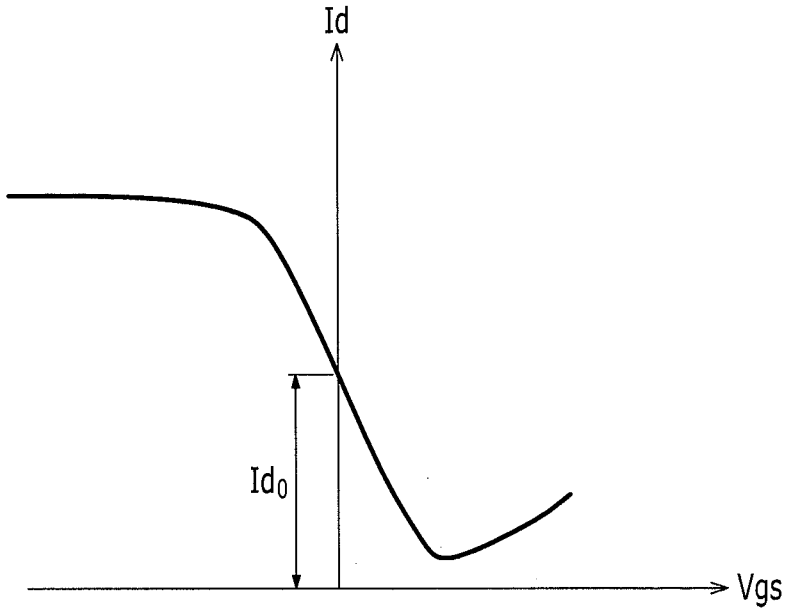
FIG. 2B is a current-voltage curve of a P-type inverse voltage transistor shown in FIG. 2A.

That is, as shown in a current-voltage curve of the P-type inverse voltage transistor M3 shown in FIG. 2B, the inverse voltage transistor M3 according to an exemplary embodiment is controlled to have the characteristic curve that is shifted to the right side compared with the general characteristic curve for the current $Id_0$ of the small amount to flow when the voltage Vgs between the gate and source electrodes is 0V. Here, the shift degree of the threshold voltage of the inverse voltage transistor M3 is not limited, however the threshold voltage may be shifted for the current $Id_0$ flowing when the voltage Vgs between the gate and source electrodes is 0V to be larger than the leakage current, or a minimum current operating the inverse voltage transistor M3 into the switch-on mode. The small current $Id_0$ is changed according to the deviation of the shift threshold voltage and the ratio between the width and the length of the channel of the inverse voltage transistor.

When the driving transistor M1 is turned on, the inverse voltage transistor M3 is operated as the constant current source such that the small current flows, however this does not significantly affect the switching on operation of the driving transistor M1 and the flowing of the driving current to the organic light emitting diode (OLED), and thereby the light emitting of the organic light emitting diode (OLED) according to the data signal is substantially not affected. The organic light emitting diode (OLED) emits the light with a predetermined luminance because of the driving current.

On the other hand, the leakage current generated when the driving transistor M1 is turned off is absorbed by the inverse voltage transistor M3 such that it does not flow to the organic light emitting diode (OLED). Also, although the gate and source electrodes are connected to each other, the threshold voltage is shifted such that the inverse voltage transistor M3 enters the switch-on mode and the current $Id_0$ may flow in the inverse voltage transistor M3 and the inverse voltage−Vbias is applied to the second node N2 through the channel of the inverse voltage transistor M3.

Thus, the anode of the organic light emitting diode (OLED) is applied with the inverse voltage such that the organic light emitting diode (OLED) is completely turned off such that the life-span of the organic light emitting diode (OLED) is improved, and the leakage current to the organic light emitting diode (OLED) is prevented such that the undesirable light emission is not generated, and accordingly the contrast ratio is improved.

FIG. 3 shows the same circuit diagram as that of FIG. 2A, and the same type of transistor, however the gate electrode of the inverse voltage transistor M30 to apply the inverse voltage is connected to the drain electrode.

That is, according to a second exemplary embodiment of FIG. 3, a pixel driver 30 formed at the intersecting region of a scan line 31 and a data line 33 and connected to a supply line 35 supplied with the first power source voltage ELVDD and the organic light emitting diode (OLED) connected to a second node N20 and a supply line 37 of the second power source voltage ELVSS are similar to the first exemplary embodiment. However, the gate electrode and the drain electrode of the inverse voltage transistor M30 are connected to each other, thereby forming a diode connection. The supply line supplied with the inverse voltage−Vbias is connected to the third node N30 at which the gate electrode and the drain electrode of the inverse voltage transistor M30 are connected to each other.

According to the exemplary embodiment of FIG. 3, the inverse voltage transistor M30 is operated as a diode, and accordingly, if the forward direction voltage is larger than the threshold voltage, the current starts to flow in the forward direction.

Here, the current that may flow in the inverse voltage transistor M30 may be changed according to the mobility of the inverse voltage transistor M30, the ratio of the width and the length of the channel of the inverse voltage transistor M30, and the voltage difference between the drain and source electrodes of the inverse voltage transistor M30. Particularly, the size of the on-resistance of the inverse voltage transistor M30 may be controlled by controlling the ratio W/L of the channel width and the length thereof of the inverse voltage transistor M30.

In the exemplary embodiment, it is preferable for the current that may flow in the inverse voltage transistor M30 to be larger than the leakage current that may be generated under the turn-off of the driving transistor M10 in a range in which the power consumption is not largely increased. In other words, it is preferable that the ratio W/L of the channel width and the length thereof of the inverse voltage transistor M30 has a size such that the leakage current may flow when the inverse voltage transistor M30 is turned off.

If the forward direction current flows to the inverse voltage transistor M30 during the period in which the driving transistor M10 is turned off, the voltage applied to the second node N20 is the voltage−Vbias+Vth_M30 reflecting the threshold voltage of the inverse voltage transistor M30 to the inverse voltage.

On the other hand, the current also flows through the inverse voltage transistor M30 during the period in which the driving transistor M10 is turned on. However, if the ratio W/L of the channel width and the length thereof of the inverse voltage transistor M30 is less than the ratio W/L of the driving transistor M10, the on-resistance of the inverse voltage transistor M30 is relatively larger than the on-resistance of the driving transistor M10 such that the current through the inverse voltage transistor M30 does not significantly affect the light emission of the organic light emitting diode (OLED).

Figure 4A:
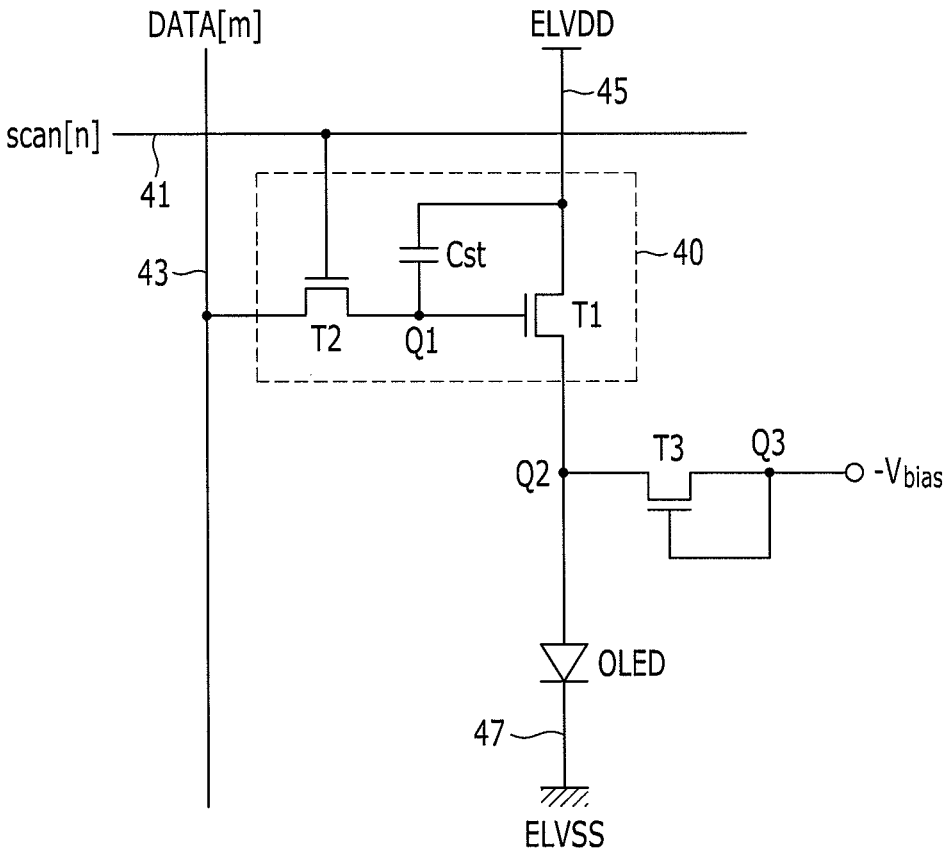
FIG. 4A is a circuit diagram of a third exemplary embodiment of the pixel shown in FIG. 1.
Figure 5:
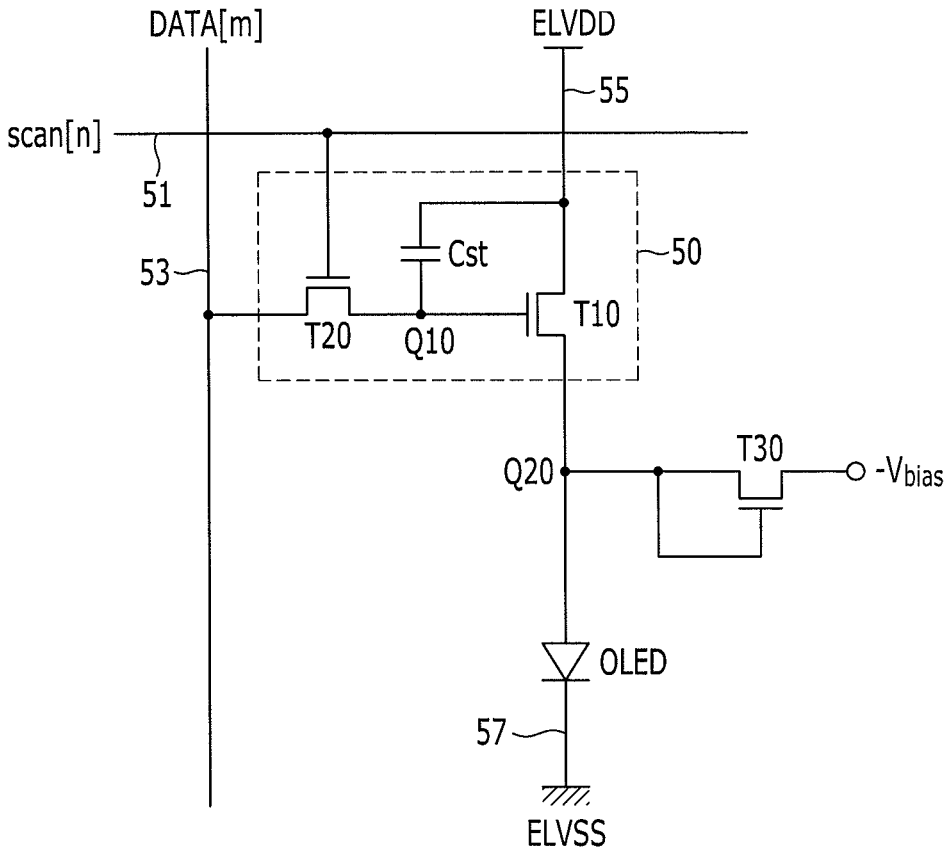
FIG. 5 is a circuit diagram of a fourth exemplary embodiment of the pixel shown in FIG. 1.

FIG. 4A and FIG. 5 are circuit diagrams according to the exemplary embodiment including the NMOS transistors as the constituents of the pixel. A third exemplary embodiment of FIG. 4A has a similar pixel structure as the first exemplary embodiment of FIG. 2A and is the structure of the inverse voltage transistor, however this exemplary embodiment uses NMOS transistors.

Figure 4B:
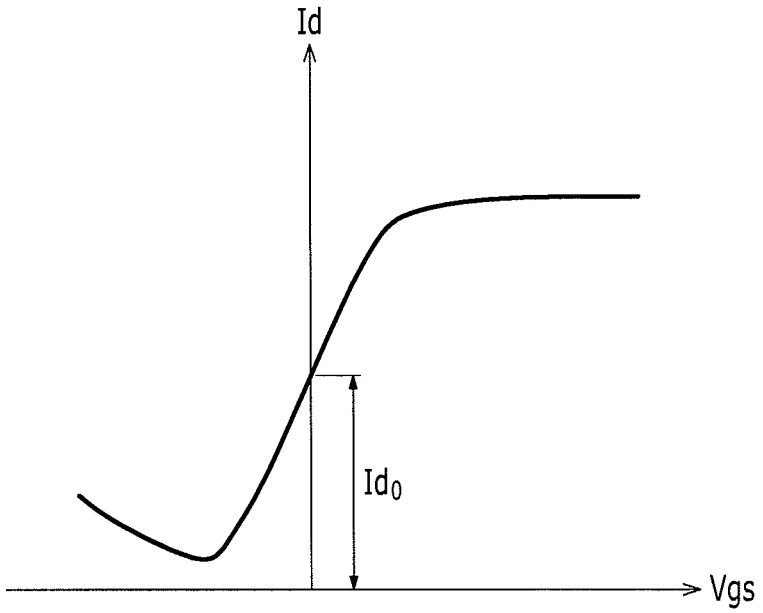
FIG. 4B is a current-voltage curve of an N-type inverse voltage transistor shown in FIG. 4A.

Accordingly, referring to FIG. 4A, the gate electrode and the source electrode of the inverse voltage transistor T3 are connected to the third node Q3 for the voltage difference Vgs between the gate and source electrodes to be 0V, and the threshold voltage is shifted to the left side compared with the general case like the current-voltage characteristic curve of FIG. 4B for the predetermined current $Id_0$ to flow. The predetermined current $Id_0$ is larger than the leakage current generated when the driving transistor T1 is turned off. Thus, the inverse voltage transistor T3 is in the switch-on mode conducts the predetermined current $Id_0$ during the period in which the driving transistor T1 is turned off such that the leakage current is shunted from the organic light emitting diode (OLED), and the inverse voltage−Vbias is applied to the second node Q20.

The fourth exemplary embodiment of FIG. 5 has a similar structure as that of the pixel of the second exemplary embodiment of FIG. 3 and the structure of the inverse voltage transistor, however the transistor is the NMOS type. The gate electrode and the drain electrode of the inverse voltage transistor T30 are connected to each other at the second node Q20, thereby forming a short circuit. Therefore, the inverse voltage transistor T30 is diode-connected, and the forward direction current flowing in the inverse voltage transistor T30 is controlled by using the ratio W/L of the width and the length of the channel of the transistor.

Preferably, it may be that the forward direction current is larger than the leakage current generated under the turn-off of the driving transistor T10 in a range in which the power consumption is not largely generated.

Figure 6:
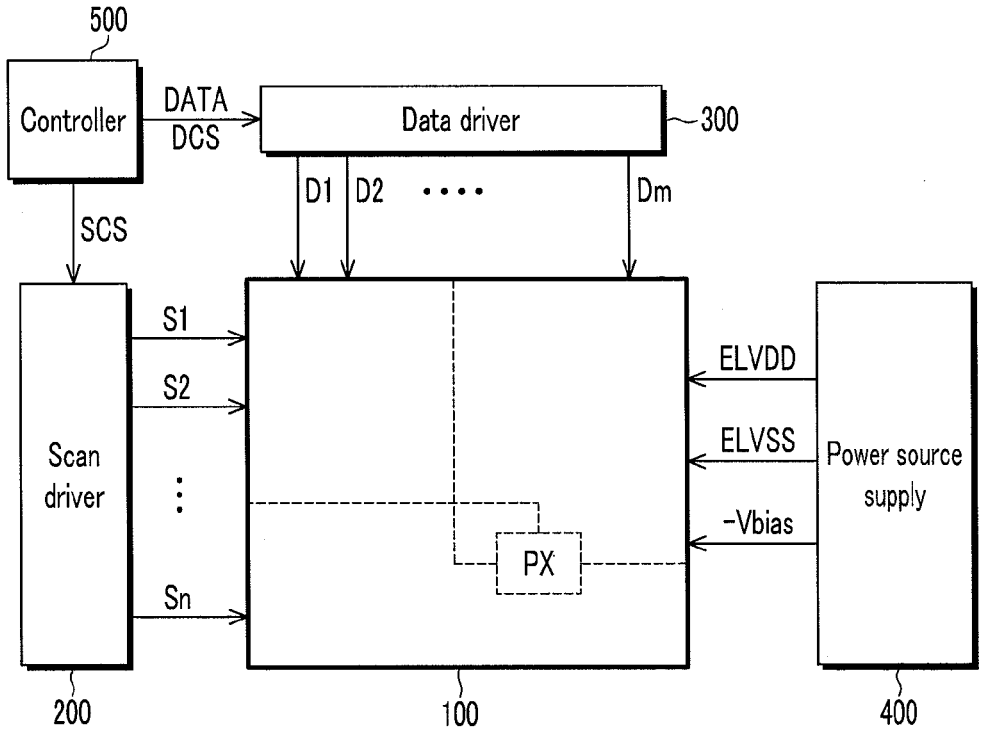
FIG. 6 is a block diagram of an organic light emitting diode (OLED) display device according to an exemplary embodiment.

FIG. 6 is a block diagram of an organic light emitting diode (OLED) display device according to an exemplary embodiment of the present invention. FIG. 6 shows an organic light emitting diode (OLED) display device including a plurality of the above-described pixels. According to FIG. 6, an organic light emitting diode (OLED) display device according to an exemplary embodiment includes a display unit 100 including a plurality of pixels PX, a scan driver 200, a data driver 300, a power supply unit 400, and a controller 500.

The plurality of pixels are respectively connected to a corresponding scan line of a plurality of scan lines S1 to Sn and a corresponding data line of a plurality of data lines D1 to Dm connected to the display unit 100. Also, the plurality of pixels are respectively connected to the power supply line connected to the display unit 100 to receive the first power source voltage ELVDD, the second power source voltage ELVSS, and the inverse voltage−Vbias from the outside.

The display unit 100 includes the plurality of pixels arranged in an approximately matrix format. Although it is not limited thereto, the plurality of scan lines are arranged in a row direction and are in parallel with each other, and the plurality of data lines are arranged in a column direction and are parallel with each other, in the arranged form of the pixels.

The plurality of pixels respectively have the above-described circuit structure and emit light of a predetermined luminance according to the driving current supplied to the organic light emitting diodes (OLED) according to the corresponding data signals transmitted through the plurality of data lines D1 to Dm.

The scan driver 200 generates and transmits a scan signal to each pixel through the plurality of scan lines S1 to Sn. That is, the scan driver 200 transmits the scan signal to the plurality of pixels included in each pixel line through the corresponding scan line. The scan driver 200 receives the scan driving control signal SCS from the controller 500 to generate the plurality of scan signals, and sequentially transmits the scan signals to the plurality of scan lines S1 to Sn connected to each pixel line. Thus, each pixel driver of the plurality of pixels included in each pixel line is activated.

The data driver 300 transmits the data signal to each pixel through the plurality of data lines D1 to Dm. The data driver 300 receives the data driving control signal DCS from the controller 500, and transmits the data signal to the plurality of data lines D1 to Dm connected to the plurality of pixels included in each pixel line.

The controller 500 changes a plurality of video signals transmitted from the outside into a plurality of image data signals DATA to transmit them to the data driver 300. The controller 500 receives a vertical synchronization signal Vsync, a horizontal synchronization signal Hsync, and a clock signal MCLK to generate and transmit the control signal to control the driving of the scan driver 200 and the data driver 300. That is, the controller 500 generates and transmits the scan driving control signal SCS controlling the scan driver 200 and the data driving control signal DCS controlling the data driver 300.

The power supply unit 400 supplies the first power source voltage ELVDD, the second power source voltage ELVSS, and the inverse voltage−Vbias to each pixel of the display unit 100. The first power source voltage ELVDD is set to have a higher voltage level than the second power source voltage ELVSS. Also, the inverse voltage−Vbias is not limited. By applying the inverse voltage−Vbias, the performance of the organic light emitting diode (OLED) is improved because leakage current does not flow and light is not emitted.

Although various features and aspects are described with reference to the detailed exemplary embodiments, this is by way of example only and the present invention is not limited thereto. A person of ordinary skill in the art may change or modify the described exemplary embodiments without departing from the scope of the present invention, and changes or modifications are also included in the scope of the present invention. Further, materials of each of the components described in the present specification may be selected from or replaced by various materials known to a person of ordinary skill in the art. In addition, a person of ordinary skill in the art may omit some of the components described in the present specification without deteriorating performance or add components in order to, for example, improve the performance. Further, a person of ordinary skill in the art may change the sequence of processes described in the present specification according to, for example, process environments or equipment.

What is claimed is:

1. A pixel comprising:

a pixel driver formed near an intersection of a scan line and a data line, wherein the pixel driver is connected to a first power source voltage supply line, and comprises:

a driving transistor configured to transmit a driving current according to a data voltage corresponding to a data signal from the data line, wherein the data voltage is applied to the driving transistor according to a scan signal transmitted from the scan line;

an organic light emitting diode (OLED) configured to emit light according to the driving current; and an inverse voltage transistor positioned between an anode of the organic light emitting diode (OLED) and a reverse bias power source, the inverse voltage transistor including a gate electrode connected to one of a first electrode and a second electrode, and configured to transmit an inverse voltage to the organic light emitting diode (OLED) during a turn-off period of the driving transistor, wherein a channel width to length ratio of the inverse voltage transistor is less than a channel width to length ratio of the driving transistor.

2. The pixel of claim 1, wherein the first electrode is a source electrode and the second electrode is a drain electrode, and wherein the gate electrode is connected to the source electrode.

3. The pixel of claim 2, wherein the inverse voltage transistor is a PMOS transistor, and the inverse voltage is applied to the drain electrode.

4. The pixel of claim 2, wherein the inverse voltage transistor is a NMOS transistor, and the inverse voltage is applied to the source electrode.

5. The pixel of claim 2, wherein a first current that may flow to the inverse voltage transistor is based at least in part on a shifted threshold voltage and a ratio of a width and a length of a channel of the inverse voltage transistor.

6. The pixel of claim 5 wherein the first current is greater than a leakage current of the driving transistor during the turn-off period of the driving transistor.

7. The pixel of claim 1, wherein the first electrode is a source electrode, the second electrode is a drain electrode, and the gate electrode is diode-connected to the drain electrode.

8. The pixel of claim 7, wherein the inverse voltage transistor is a PMOS transistor and the drain electrode is applied with the inverse voltage.

9. The pixel of claim 7, wherein the inverse voltage transistor is an NMOS transistor and the source electrode is applied with the inverse voltage.

10. The pixel of claim 7, wherein a first current that may flow in the inverse voltage transistor is based at least in part on the mobility of the inverse voltage transistor, a ratio of a width and a length of the channel of the inverse voltage transistor, and a voltage difference between a drain electrode and a source electrode of the inverse voltage transistor.

11. The pixel of claim 10, wherein the first current is larger than the leakage current of the driving transistor during the turn-off period of the driving transistor.

12. The pixel of claim 1, wherein the pixel driver includes:

a switching transistor transmitting a data signal from the data line to a first node when turned on in response to the scan signal transmitted from the scan line;

a capacitor including first and second electrodes respectively connected to the first node and the first power source voltage supply line and configured to store a voltage according to a difference between the data voltage according to the data signal applied to the first node and a first power source voltage; and a driving transistor connected between the first power source voltage supply line and a second power source voltage supply line and generating a driving current corresponding to the voltage stored by the capacitor.

13. An organic light emitting diode (OLED) display device comprising:

a scan driver transmitting a plurality of scan signals to a plurality of scan lines;

a data driver transmitting a plurality of data signals to a plurality of data lines;

a controller controlling the scan driver and the data driver, and generating and supplying an image data signal corresponding to a video signal to the data driver;

a display unit including a plurality of pixels respectively connected to a corresponding scan line of a plurality of scan lines and a corresponding data line of a plurality of data lines, wherein the plurality of pixels emit light according to the image data signal; and a power source supply supplying a first power source voltage, a second power source voltage, and an inverse voltage to the plurality of pixels, wherein the plurality of pixels respectively include:

a driving transistor configured to transmit a driving current according to a data voltage corresponding to the data signal transmitted from the data line;

an organic light emitting diode (OLED) configured to emit light according to the driving current; and an inverse voltage transistor positioned between an anode of the organic light emitting diode (OLED) and a reverse bias power source, the inverse voltage transistor including a gate electrode connected to one of a first electrode and a second electrode, and configured to transmit the inverse voltage to the organic light emitting diode (OLED), wherein a channel width to length ratio of the inverse voltage transistor is less than a channel width to length ratio of the driving transistor.

14. The organic light emitting diode (OLED) display device of claim 13, wherein the inverse voltage transistor includes:

the first electrode and the second electrode that are respectively a source electrode and a drain electrode, wherein the gate electrode is connected to the source electrode.

15. The organic light emitting diode (OLED) display device of claim 14, wherein the inverse voltage transistor is a PMOS transistor, and the inverse voltage is applied to the drain electrode.

16. The organic light emitting diode (OLED) display device of claim 14, wherein the inverse voltage transistor is an NMOS transistor, and the inverse voltage is applied to the source electrode.

17. The organic light emitting diode (OLED) display device of claim 13, wherein the inverse voltage transistor includes:

the first electrode and the second electrode that are respectively a source electrode and a drain electrode, and the gate electrode is diode-connected to the drain electrode.

18. The organic light emitting diode (OLED) display device of claim 17, wherein the inverse voltage transistor is a PMOS transistor, and the drain electrode is applied with the inverse voltage.

19. The organic light emitting diode (OLED) display device of claim 17, wherein the inverse voltage transistor is an NMOS transistor, and the source electrode is applied with the inverse voltage.

* * * * *